US007191703B2

(12) United States Patent
Dilling

(10) Patent No.: US 7,191,703 B2
(45) Date of Patent: Mar. 20, 2007

(54) WEB-FED PRESS

(75) Inventor: Peer Dilling, Friedberg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 26 days.

(21) Appl. No.: 11/120,845

(22) Filed: May 3, 2005

(65) Prior Publication Data

US 2005/0263018 A1 Dec. 1, 2005

(30) Foreign Application Priority Data

May 5, 2004 (DE) ..... 10 2004 022 074

(51) Int. Cl.
*B41F 13/56* (2006.01)

(52) U.S. Cl. ..... 101/227; 101/92; 101/183; 101/228

(58) Field of Classification Search ..... None
See application file for complete search history.

(56) References Cited

U.S. PATENT DOCUMENTS 2,250,534 A * 7/1941 Higgins et al. ..... 101/92
3,147,006 A * 9/1964 Fulk ..... 270/18
4,512,256 A * 4/1985 Schriber et al. ..... 101/248
4,718,340 A * 1/1988 Love, III ..... 101/116
4,966,352 A * 10/1990 Nuttin ..... 270/1.01
5,479,856 A * 1/1996 Wirz ..... 101/177
5,533,453 A * 7/1996 Wolfberg et al. ..... 101/485
2002/0100381 A1* 8/2002 Schneider et al. ..... 101/247

FOREIGN PATENT DOCUMENTS

DE 10115434 A1 * 10/2002

* cited by examiner

*Primary Examiner*—Daniel J. Colilla
*Assistant Examiner*—Jill E. Culler
(74) *Attorney, Agent, or Firm*—Leydig, Voit & Mayer, Ltd.

(57) ABSTRACT

A web-fed press is provided. The web-fed press includes a reel carrier and a plurality of printing units arranged one after another for printing a printing material with a static printed image. The web-fed press includes a folder superstructure that is arranged after the printing units and a folding unit arranged after the folder superstructure. An imprinting unit for individualizing the static printed image with, in particular, changing text and/or image constituents is integrated into the web-fed press in the region of the folder superstructure.

4 Claims, 3 Drawing Sheets

WEB-FED PRESS

FIELD OF THE INVENTION

The invention relates to a web-fed press.

BACKGROUND OF THE INVENTION

Web-fed presses typically include a reel carrier for the printing material. The printing material is pulled off the reel carrier and moved successively, through a plurality of printing units. A printing ink being applied to the printing material, preferably to the underside and to the upper side of the same, in each printing unit. In the case of half-tone overprinting, four printing units are generally arranged one after another with one of the process colors (i.e., black, cyan, magenta and yellow) being applied to the printing material in each of the printing units.

A folder superstructure is connected after the printing units. A so-called folding unit is arranged after the folder superstructure. In the folder superstructure, the printed printing material is preferably cut and fed to the folding unit over turner bars in suitable relative positions. A web-fed press of this type is known, for example, from "Handbuch der Printmedien" [Manual of Printing Media], Helmut Kipphan, page 160, 2000, Springer-Verlag.

Furthermore, integrating what is known as an imprinting unit (also called an imprinter) into such a web-fed press is already known from the prior art. Such imprinting units are used for the individualization of a static printed image printed in the printing units with, in particular, changing text constituents or image constituents. According to the prior art, the imprinting unit is integrated into the web-fed press in such a way that the imprinting unit is arranged between the reel carrier and the first printing unit for producing the static printed image.

BRIEF SUMMARY OF THE INVENTION

A general object of the present invention is to provide an improved web-fed press. The web press of the present invention includes an imprinting unit that is integrated into the web-fed press in the region of the folder superstructure. In particular, according to one embodiment of the present invention, the imprinting unit is integrated after a cutting device belonging to the folder superstructure.

With integration of the imprinting unit in the region of the folder superstructure according to the invention, existing web-fed presses can be retrofitted with an imprinting unit in a simple and cost-effective manner. Furthermore, the arrangement of the imprinting unit in the region of the folder superstructure according to the invention can be advantageous because, as a rule, only selected pages of a printed product are individualized with changing text constituents or else image constituents.

According to a preferred embodiment of the invention, the folder superstructure includes a cutting device and turner bars and the imprinting unit is integrated into the web-fed press between the cutting device and the turner bars in such a way that the the imprinting unit is assigned only to a partial web of the printing material divided by the cutting device. The imprinting unit is preferably constructed as a digital printing device that operates in accordance with the direct imaging principle.

BRIEF DESCRIPTION OF THE SEVERAL VIEWS OF THE DRAWING(S)

DETAILED DESCRIPTION OF THE INVENTION

Figure 1:
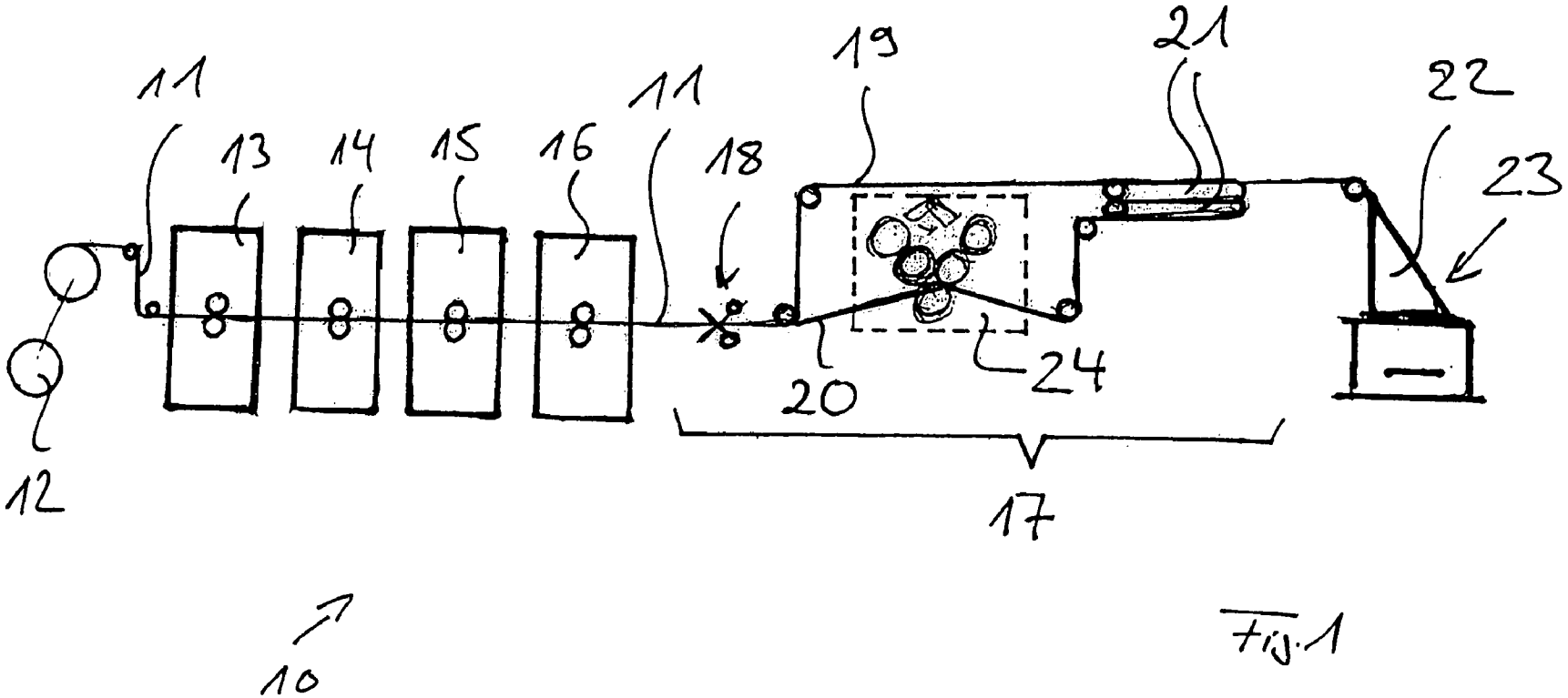
FIG. 1 is a highly schematic side view of an exemplary web-fed press according to the invention.

Referring now to the drawings, a web-fed press 10 having a horizontal web run of a printing material 11 is illustrated in FIG. 1. The web-fed press 10 of FIG. 1 preferably is a jobbing press. In such a web-fed press 10, the printing material 11 is kept ready on a reel carrier 12, is unwound from the latter and moved through a plurality of printing units 13, 14, 15 and 16 arranged one after another. The printing units 13 to 16 can be used to print the printing material 11 with a static printed image. In the case of half-tone overprinting, one of the process colors (black, cyan, magenta and yellow) is applied to the printing material 11 in each of the printing units 13 to 16, preferably to an upper side and an underside of the printing material.

Following the printing of the printing material 11 in the printing units 13 to 16, the printing material 11 is supplied to what is known as a folder superstructure 17 of the web-fed press 10. As shown in FIG. 1, the printing material 11 is preferably divided centrally in the region of the folder superstructure 17 by using a cutting device 18. Thus, the printing material is usually pulled off the reel carrier 12 and moved through the printing units 13 to 16 to comprise, for example, a width of four pages. After the division of the printing material 11 with the aid of the cutting device 18, there are two partial webs 19 and 20 of the printing material 11, each having a width of two pages.

The folder superstructure 17 of the FIG. 1 embodiment further includes turner bars 21. With the aid of the turner bars 21, the partial webs 19 and 20 originally positioned beside each other can be aligned in such a way that the partial webs are aligned one above the other after leaving the turner bars. Following the turner bars, the so-aligned partial webs 19 and 20 of the printing material 21 are fed to the former 22 of the folding unit 23.

According to an aspect of the present invention, an imprinting unit 24, which is also designated an imprinter, is integrated into the web-fed press 10 in the region of the folder superstructure 17, namely between the cutting device 20 and the turner bars 21 of the folder superstructure 17. As shown in FIG. 1, only the partial web 20 is moved through the region of the imprinting unit 24, whereas the partial web 19 of the printing material 11 is moved past the imprinting unit 24. Accordingly, in the illustrated embodiment, the imprinting unit 24 integrated into the folder superstructure 17 is assigned to only one partial web, namely the partial web 20, of the printing material 11 divided by the cutting device 18.

The present invention thus allows the printing material 11 to be individualized by printing only in the region of a part web 20 by means of changing text constituents or else image constituents. This aspect of the invention is based on the finding that printed products produced on a web-fed press 10 are usually individualized by means of dynamic text constituents or image constituents only in the area of some pages. On the other hand, the other pages are built up from a completely static printed image. The imprinting unit 24 is accordingly assigned only to the partial web 20 that has the pages of the printed product to be produced that are to be individualized with dynamic text or image constituents.

Figure 2:
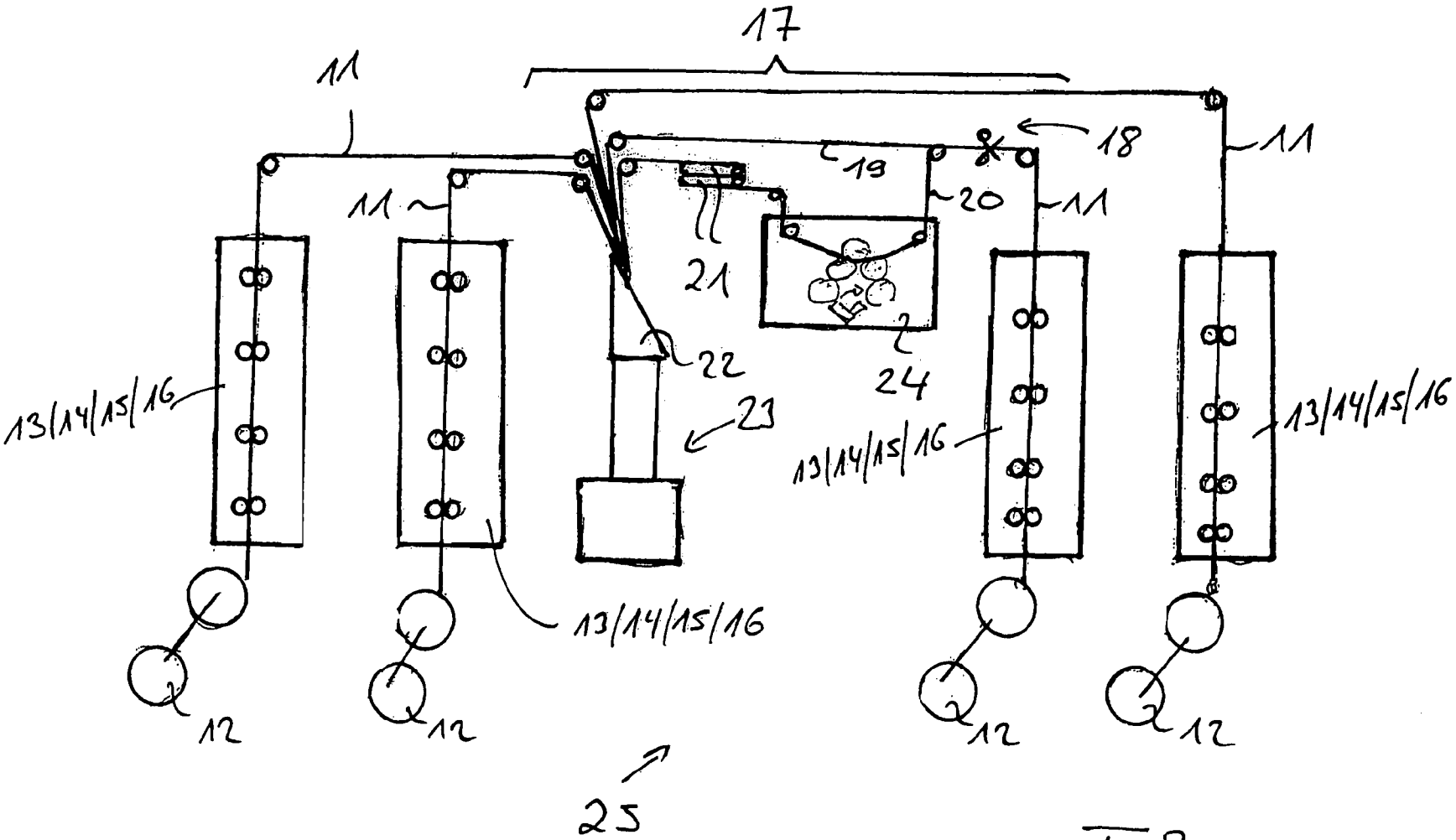
FIG. 2 is a highly schematic side view of an alternative embodiment of a web-fed press according to the invention.

A further exemplary embodiment of a web-fed press 25 according to the invention is shown in FIG. 2. The web-fed press of FIG. 2 is characterized by a vertical web run of the printing material. The press 25 according to FIG. 2 is a newspaper press. As shown in FIG. 2, the web-fed press 25 includes a plurality of reel carriers 12 and a plurality of groups of printing units 13, 14, 15 and 16. Different pages of the newspaper to be printed are printed in each of these groups of printing units 13–16. Since the construction of the press 25 according to FIG. 2 corresponds substantially to the construction of the press 10 according to FIG. 1, identical reference numbers are used here for identical subassemblies, in order to avoid unnecessary repetition.

In the embodiment illustrated in FIG. 2, an imprinting unit 24 is assigned only to one group of printing units 13–16 in the area of the folder superstructure 17, namely to a partial web 20 of the printing material 11 divided by the cutting device 18. To this extent, by using the web-fed press 25 of FIG. 2, only some pages of the newspaper to be printed are also individualized with changing or dynamic text or image constituents.

Figure 3:
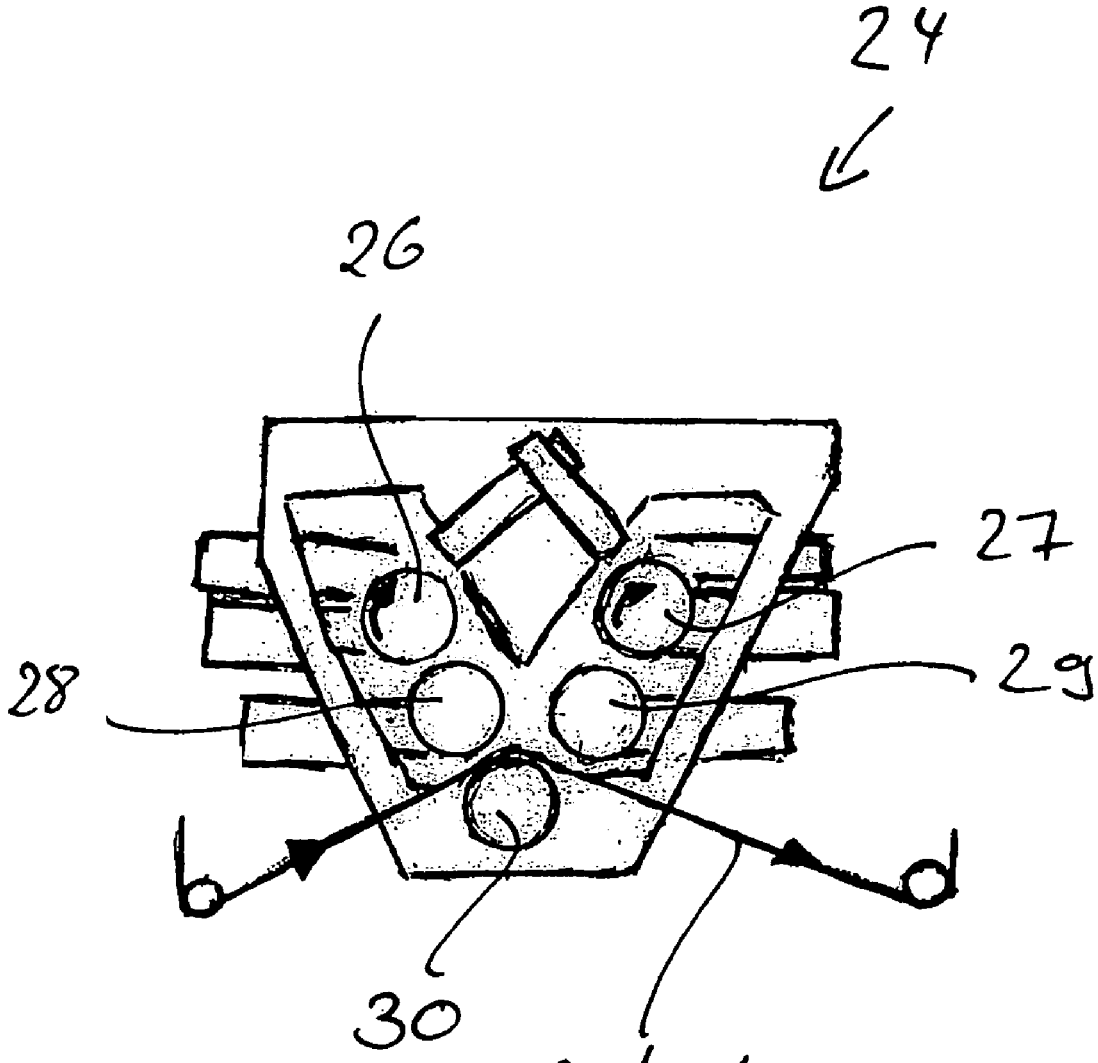
FIG. 3 is a highly schematic side view of the imprinting unit of the web-fed presses according to FIGS. 1 and 2.

FIG. 3 shows an exemplary imprinting unit 24 in greater detail. The imprinting unit 24 includes two form cylinders 26 and 27, two rubber-covered cylinders 28 and 29 and an impression cylinder 30. The rubber-covered cylinder 28 interacts with the form cylinder 26 and the rubber-covered cylinder 29 interacts with the form cylinder 27. On the other hand, both rubber-covered cylinders 28 and 29 interact with the same impression cylinder 30.

With the aid of the imprinting unit 24 of FIG. 3, it is possible to print a plurality of dynamic constituents of the printed image simultaneously onto the printing material 11, namely the partial web 20 of the same, using a single impression cylinder 30. In addition, during printing it is possible to switch to and fro as desired between the form cylinder 26 and the form cylinder 27 and, respectively, the corresponding rubber-covered cylinders 28 and 29. In this case, a changing text or image constituent can then be applied to the partial web 20 of the printing material 11 by means of the form cylinder 26 and the rubber-covered cylinder 28, for example, whereas set-up work is carried out on the form cylinder 27 and the rubber-covered cylinder 29.

As an alternative to the imprinting unit of FIG. 3, an imprinting unit having a form cylinder, a rubber-covered cylinder and an impression cylinder can also be used. Such an imprinting unit operates on what is known as the rubber-satellite principle. An imprinting unit having two form cylinders and two rubber-covered cylinders, which operates in accordance with what is known as the rubber-rubber principle, also can be used. Further types of imprinting units can be selected by those skilled in the art. The imprinting unit can be operated in the recto printing process or in the perfecting process.

A refinement of the present invention in which the imprinting unit 24 is constructed as a digital printing device that operates with a rewritable and erasable printing form in accordance with the direct imaging principle is particularly preferred. Printing devices of this type are marketed by the assignee of the present application under the product designation "DICOweb". Corresponding details of the "DICOweb" printing devices are familiar to those skilled in the art and therefore require no further explanation.

LIST OF REFERENCE SYMBOLS

10. Web-fed press
11. Printing material
12. Reel carrier
13. Printing system
14. Printing system
15. Printing system
16. Printing system
17. Folder superstructure
18. Cutting device
19. Partial web
20. Partial web
21. Turner bar
22. Former
23. Folding unit
24. Imprinting unit
25. Web-fed press
26. Form cylinder
27. Form cylinder
28. Rubber-covered cylinder
29. Rubber-covered cylinder
30. Impression cylinder

The invention claimed is:

1. A -web-fed press comprising:
a reel carrier;
a plurality of printing units arranged one after another for printing a printing material with a static printed image;
a folder superstructure arranged after the printing units, said folder superstructure including a cutting device and turner bars;
a folding unit arranged after the folder superstructure; and
an imprinting unit for individualizing the static printed image with changing text and/or image constituents, said imprinting unit being integrated into the web-fed press between said cutting device and said turner bars.

2. The web-fed press according to claim 1, wherein the imprinting unit is assigned only to a partial web of the printing material that is divided by the cutting device.

3. The web-fed press according to claim 1, wherein the imprinting unit comprises a digital printing device that operates with rewritable and erasable printing forms in accordance with the direct imaging principle.

4. The web-fed press according to claim 1, wherein the imprinting unit comprises two form cylinders, two rubber-covered cylinders and an impression cylinder, each of the rubber-covered cylinders interacting with a respective one of the,two form cylinders and with the impression cylinder.

* * * * *